US008070528B2

(12) United States Patent
Wang et al.

(10) Patent No.: US 8,070,528 B2
(45) Date of Patent: Dec. 6, 2011

(54) ELECTRICAL CONNECTOR HAVING IMPROVED TERMINALS

(75) Inventors: Hong-Wu Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 75 days.

(21) Appl. No.: 12/548,717

(22) Filed: Aug. 27, 2009

(65) Prior Publication Data

US 2010/0055979 A1 Mar. 4, 2010

(30) Foreign Application Priority Data

Aug. 27, 2008 (CN) ..... 2008 2 20041470

(51) Int. Cl.
*H01R 24/04* (2006.01)

(52) U.S. Cl. ..... 439/668; 439/669

(58) Field of Classification Search ..... 439/668, 439/669

See application file for complete search history.

(56) References Cited

U.S. PATENT DOCUMENTS 5,919,052 A * 7/1999 Ho ..... 439/668
6,000,970 A * 12/1999 Wu ..... 439/669
6,056,602 A * 5/2000 Wu ..... 439/668
6,116,959 A * 9/2000 Taylor ..... 439/668
6,220,898 B1 * 4/2001 Wu ..... 439/668
6,244,905 B1 * 6/2001 Wang ..... 439/668
6,368,156 B1 * 4/2002 Lin ..... 439/668
6,478,594 B1 * 11/2002 Curtin et al. ..... 439/188
6,690,801 B2 2/2004 Yeh
7,316,587 B2 * 1/2008 Chien et al. ..... 439/668
2007/0049124 A1 * 3/2007 Chien et al. ..... 439/668

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

An electrical connector (100) for insertion of an electrical plug, includes an insulative housing (1) having a receiving cavity (13) to receive the electrical plug in a front-to-rear direction and a plurality of receiving slots (14) communicating with the receiving cavity, and a set of terminals (2) received in the receiving slots and including first terminals (21). Each first terminal has a vertical flat first base portion (212) retained in the insulative housing and extending along the front-to-rear direction, a first contacting portion (211) protruding into the receiving cavity to electrical contact with the electrical plug, and a first tail portion (213) to be mounted on a printed circuit board (PCB). Both the first contacting portion (211) and the first tail portion (213) simultaneously extend from one of an upper edge and lower edge of the first base portion (212).

20 Claims, 6 Drawing Sheets

ELECTRICAL CONNECTOR HAVING IMPROVED TERMINALS

BACKGROUND OF THE INVENTION

1. Field of the Invention

The present invention generally relates to the art of electrical connectors and more particularly to an electrical connector for receiving an electrical plug.

2. Description of Related Art

A conventional electrical connector for receiving an electrical plug in a front-to-rear direction are often mounted on a printed circuit board (PCB) for use in a variety of electronic equipment such as telecommunications equipment, computers and the like. Such electrical connector usually comprises an insulative housing, a plurality of terminals coupled thereto, and a shell shielding the insulative housing. The terminals are stamped and formed of conductive sheet metal materials. The terminal has a vertical flat base portion retained in the insulative housing and extending along the front-to-rear direction, a tail portion extending from a lower edge of the base portion to be mounted on the PCB, and a contacting portion extending from an upper edge of the base portion to electrical contact with the electrical plug.

However, the contacting portion and the tail portion extending from different edges of the base portion will increase the width in a height direction of the sheet metal materials which stamp out the terminals, and the material costs will be increased.

Hence, an improvement over the prior art is required to overcome the problems thereof.

SUMMARY OF THE INVENTION

According to one aspect of the present invention, an electrical connector for insertion of an electrical plug, comprises an insulative housing having a receiving cavity to receive the electrical plug in a front-to-rear direction and a plurality of receiving slots communicating with the receiving cavity, and a plurality of terminals received in the receiving slots and including first terminals. Each first terminal has a vertical flat first base portion retained in the insulative housing and extending along the front-to-rear direction, a first contacting portion protruding into the receiving cavity to electrical contact with the electrical plug, and a first tail portion to be mounted on a printed circuit board (PCB). Both the first contacting portion and the first tail portion simultaneously extend from one of an upper edge and lower edge of the first base portion.

According to another aspect of the present invention, an electrical connector for insertion of an electrical plug comprises an insulative housing having a main body, a cylindrical mating portion extending forwardly from a front face of the main body, and a receiving cavity formed in the mating portion and the main body for inserting the electrical plug in a front-to-rear direction, a plurality of terminals including a pair of first terminals having vertical flat first base portions retained in two lateral sides of the main body and extending along the front-to-rear direction, first contacting portions extending from lower edges of the respective first base portions and protruding into the receiving cavity to electrical contact with the electrical plug, and first tail portions extending from lower edges of the respective first base portions to be mounted on a printed circuit board (PCB), and a shell shielding the insulative housing.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
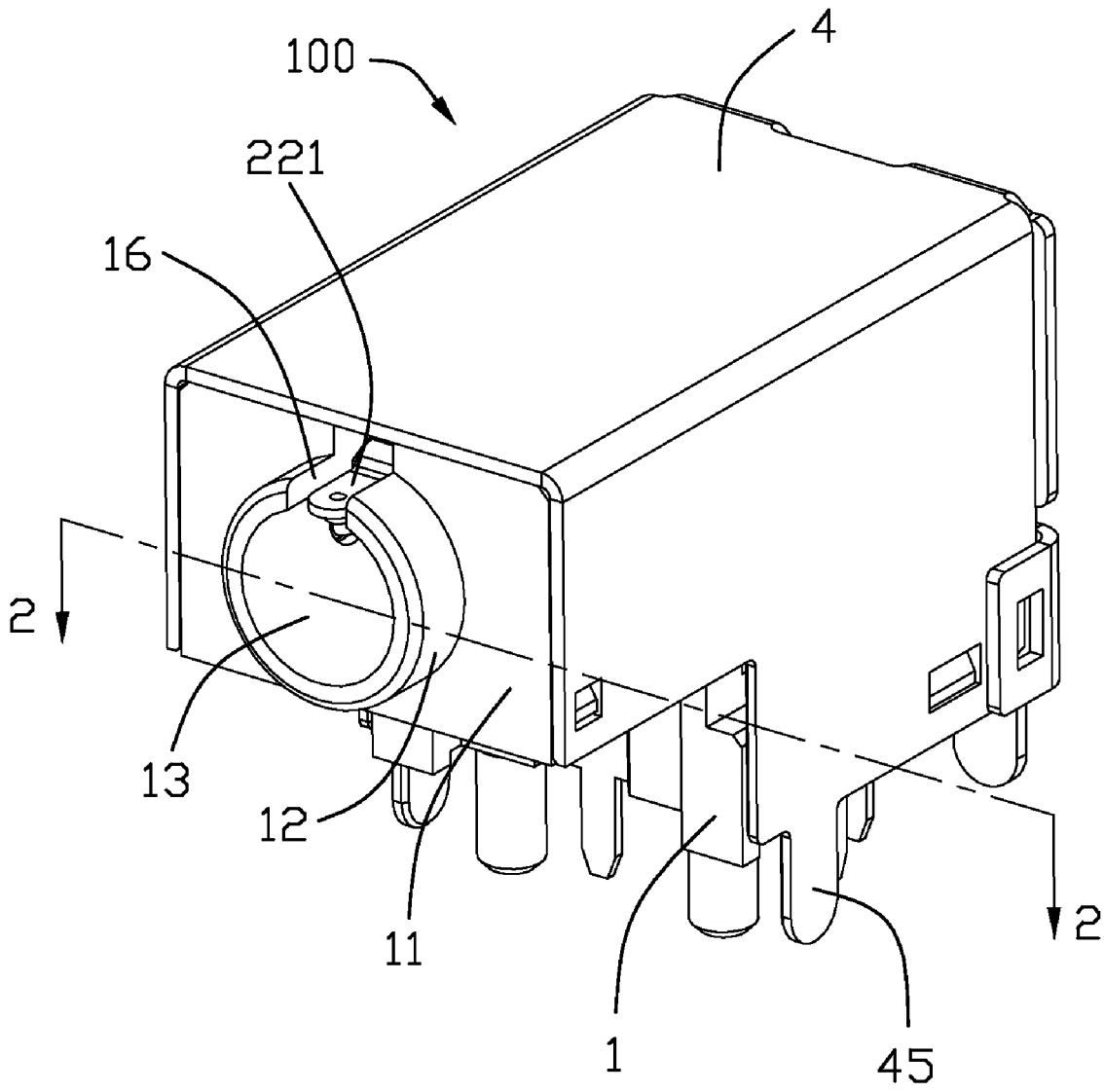
FIG. 1 is a perspective view of an electrical connector according to the present invention.

Reference will now be made to the drawing figures to describe the preferred embodiment of the present invention in detail.

Figure 5:
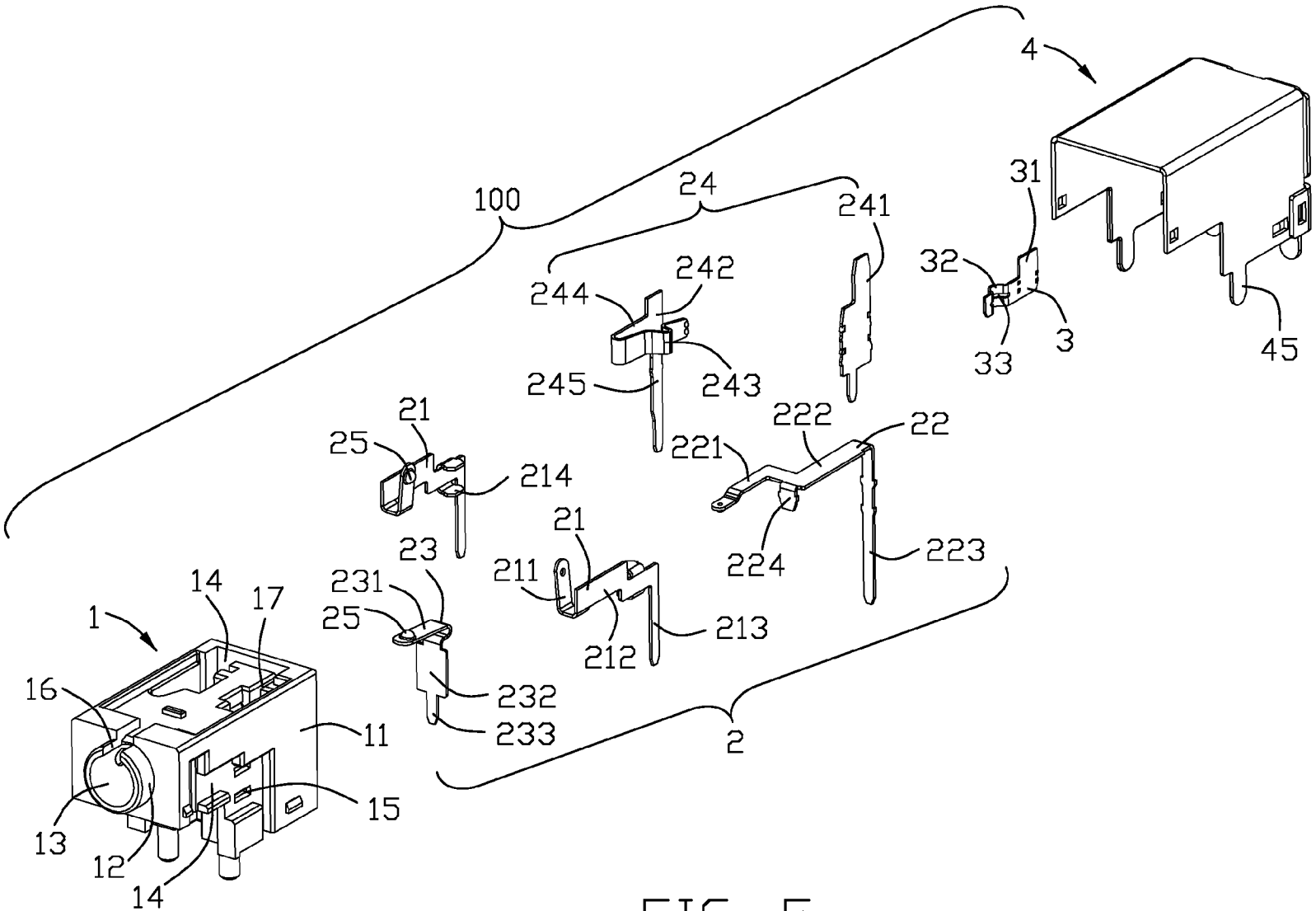
FIG. 5 is an exploded view of the electrical connector shown in FIG. 1.
Figure 6:
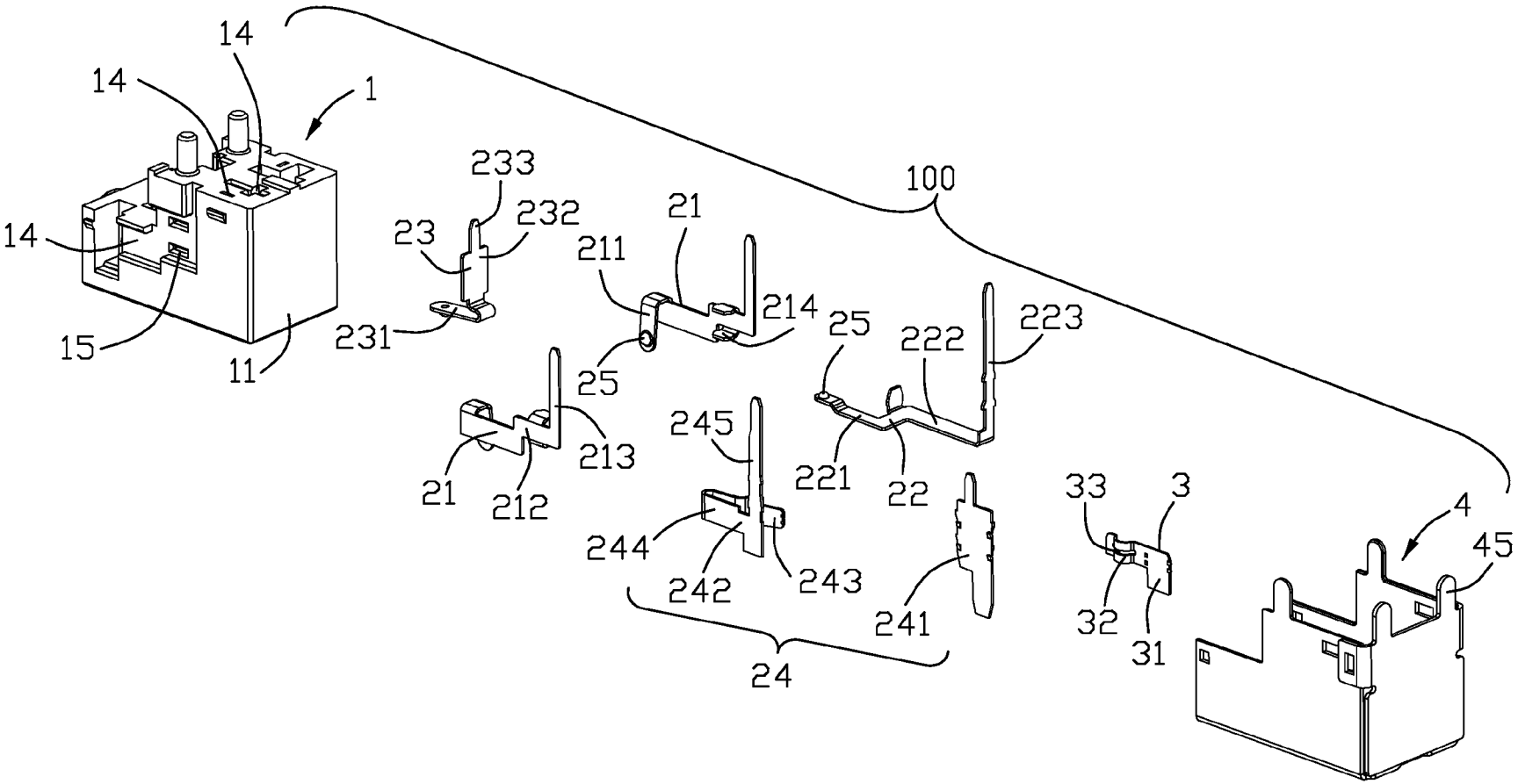
FIG. 6 is an another exploded view of the electrical connector shown in FIG. 1.

Referring to FIGS. 5 and 6, an electrical connector 100 for insertion of an electrical plug (not shown) and adapted for mounting on a printed circuit board (PCB) according to the present invention, comprises an insulative housing 1, a plurality of terminals 2 retained in the insulative housing 1, a retaining member 3, and a metal shell 4 shielding the insulative housing 1.

Referring to FIGS. 5 and 6, the insulative housing 1 includes a main body 11, a cylindrical mating portion 12 extending forwardly from a front face of the main body 11, and a receiving cavity 13 formed in the mating portion 12 and the main body 11 for inserting the electrical plug in a front-to-rear direction. A gap 16 extends through an upper side of the mating portion 12 and communicates with the receiving cavity 13. The main body 11 has a plurality of receiving slots 14 for receiving the terminals 2 and communicating with the receiving cavity 13, and a groove 17 extending through an upper side and a lower side thereof for receiving the retaining member 3 a pair of retaining slots 15 are formed on each of two lateral sides of the main body 11 and communicate with the receiving slots 14 on the two lateral sides thereof.

Referring to FIGS. 1-6, the terminals 2 include a pair of first terminals 21 retained in the two lateral sides of the main body 11, a second terminal 22 retained in the upper side of the main body 11, a third terminal 23 retained in the lower side of the main body 11, and a pair of switch terminals 24 retained in the main body 11. The first terminals 24 are of similar configuration and are symmetrically received in the receiving slots 14 on the two lateral sides of the main body 11 each first terminal 21 is stamped and formed of conductive sheet metal materials and includes a vertical flat first base portion 212 extending along the front-to-rear direction, a first tail portion 213 extending downwardly from a rear end of a lower edge at the first base portion 212 to be mounted on the PCB, and a first contacting portion 211 extending inwardly and then upwardly from a front end of a lower edge at the first base portion 212. Each first contacting portion 211 defines a convex protrusion 25 protruding into the receiving cavity 13 to contact with the electrical plug. When the electrical plug is inserted into the receiving cavity 13, the convex protrusions 25 of the first contacting portions 211 are symmetrically located at two lateral sides of the electrical plug along a transverse direction perpendicular to the front-to-rear direction. Therefore, the convex protrusions 25 will give the electrical plug a balance force so as to prevent the electrical plug from swinging. The first base portion 212 has a pair of first tooth portions 214 formed on the lower and upper edges thereof respectively to be inserted into the respective retaining slots 15 of the main body 11. The first tooth portions 214 are parallel to each other along a height direction of the insulative housing 1. Therefore, the first terminals 21 could be retained in the insulative housing 1 steadily. Both the first contacting portion 211 and the first tail portion 213 both extend from the lower edge of the first base portion 212. Therefore, a width in a height direction of the sheet metal materials which stamp out the first terminals 21 will be diminished efficiently and the material costs will be decreased. In an alternative embodiment of the present invention, the first contacting portion 211 and the tail portion 213 could both extend from the upper edge of the first base portion 212.

Figure 3:
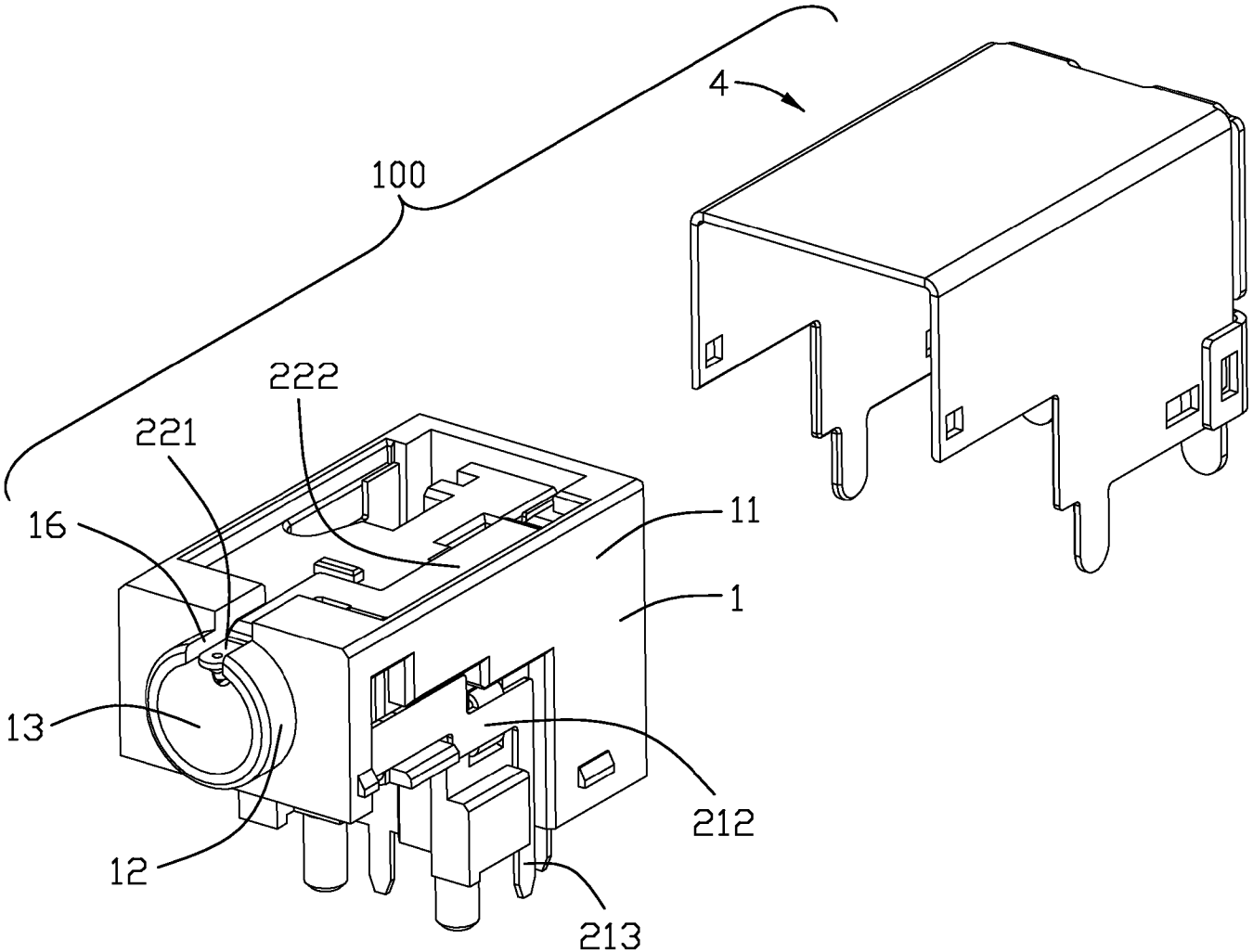
FIG. 3 is a partly exploded view of the electrical connector shown in FIG. 1.
Figure 4:
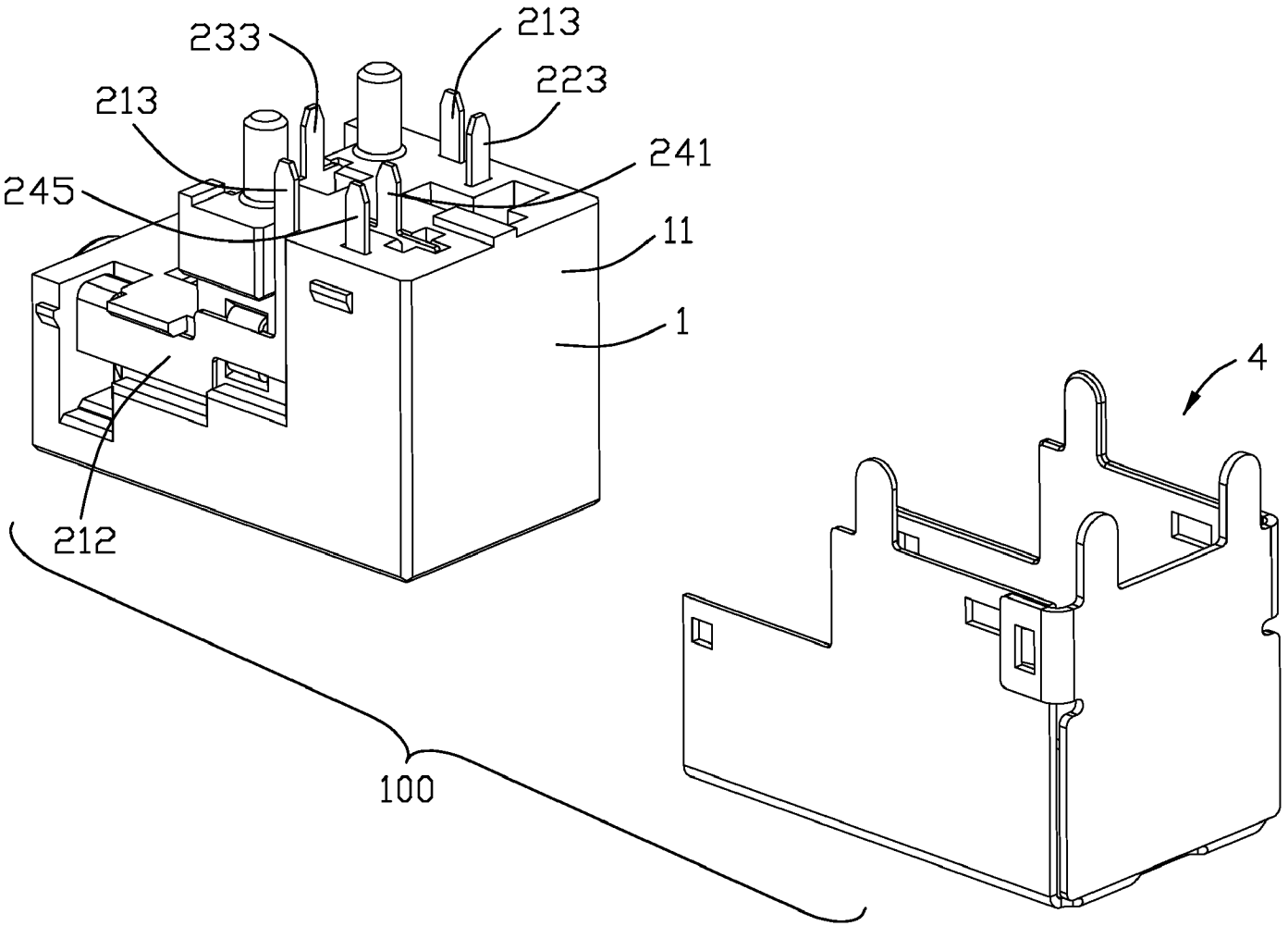
FIG. 4 is an another partly exploded view of the electrical connector shown in FIG. 1.

Referring to FIGS. 3, 5 and 6, the second terminal 22 is received in the receiving slot 14 on the upper side of the main body 11 and includes a horizontal flat second base portion 222 extending along the front-to-rear direction, a second contacting portion 221 extending sidewardly from a front end of a side edge at the second base portion 222 and bending forwardly at a proper position, and a second tail portion 223 extending downwardly from a rear end of the second base portion 222 to be mounted on the PCB. The second contacting portion 221 is received in the gap 16 and defines a convex protrusion 25 protruding into the receiving cavity 13 to electrical contact with the electrical plug. The second base portion 222 has a second tooth portion 224 extending downwardly from a front end thereof to be retained in the main body 11. The third terminal 23 is received in the receiving slot 14 on the lower side of the main body 11 and includes vertical flat third base portion 232 extending along a height direction of the main body 11, a third contacting portion 231 bending forwardly from an upper end of the third base portion 232, and a third tail portion 233 extending downwardly from a lower end of the base portion 232 to be mounted on the PCB. The third contacting portion 231 defines a convex protrusion 25 protruding upwardly into the receiving cavity 13 to electrical contact with the electrical plug.

Figure 2:
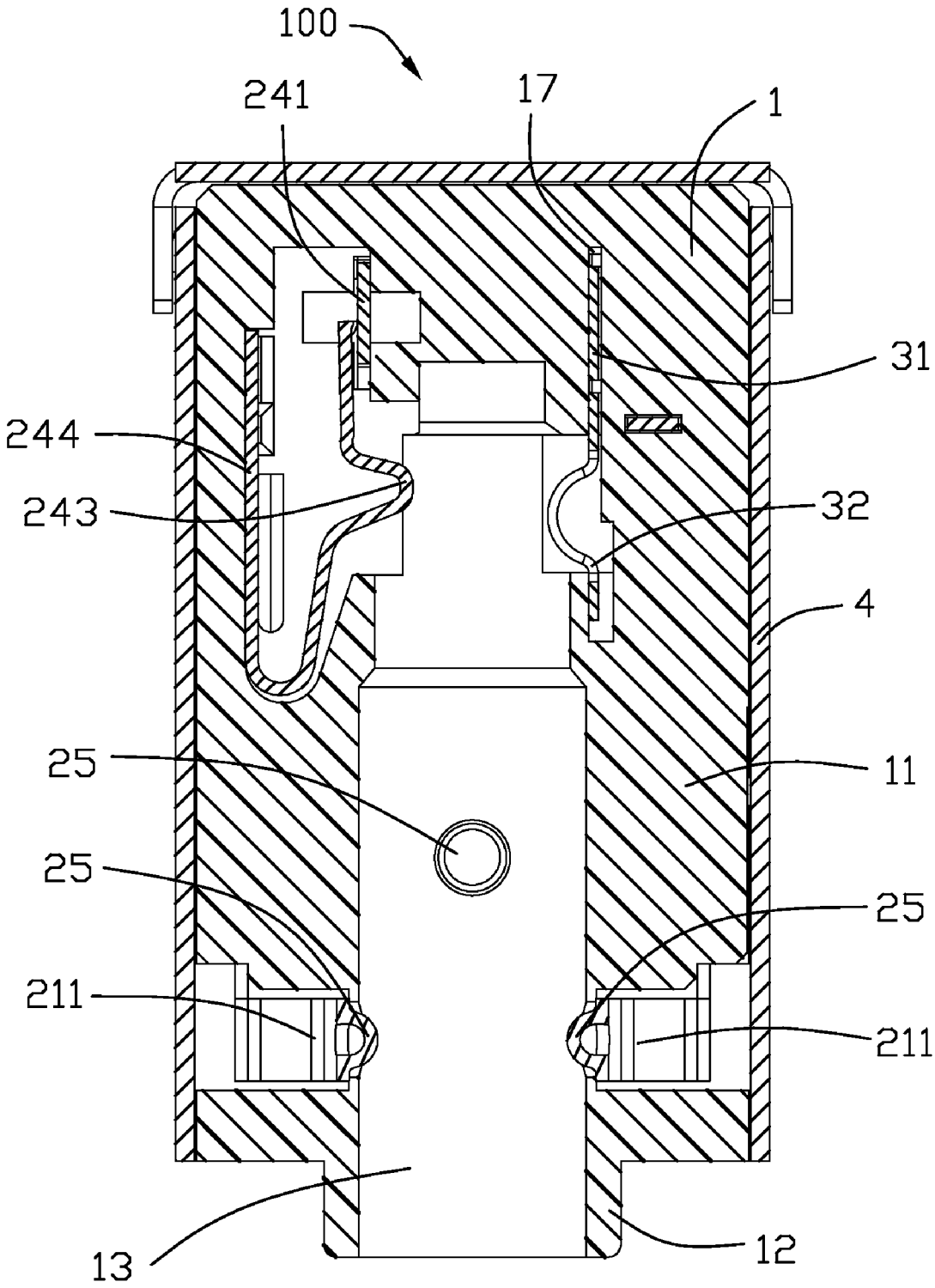
FIG. 2 is a cross-sectional view of the electrical connector taken along line 2-2 shown in FIG. 1.

Referring to FIGS. 2, 5 and 6, the switch terminals 24 are received in the receiving slot 14 and include an immovable terminal 241 and an elastic terminal 242. The elastic terminal 242 includes a vertical flat fourth base portion 244 extending along the front-to-rear direction, a fourth contacting portion 243 extending inwardly and backwardly from a front end of the fourth base portion 244, and a fourth tail portion 245 extending downwardly from a rear end of a lower edge at the fourth base portion 244 to be mounted on the PCB. The fourth contacting portion 243 defines an arc portion bowed toward the receiving cavity 13 to electrical contact with the electrical plug. The fourth contacting portion 243 is brought into or out of contacting with the immovable terminal 241 with insertion or extraction of the electrical plug. Therefore, the switch terminals 24 are able to detect the insertion of the electrical plug.

The retaining member 3 is received in the groove 17 and includes a vertical flat retaining portion 31, and a resisting portion 32 extending forwardly from a front end of the retaining portion 31 and protruding into the receiving cavity 13 to press against the electrical plug. The resisting portion 32 has a slit 33 formed thereon and extending along the front-to-rear direction. The slit 33 engages with the electrical plug so as to optimize insertion and extraction force of the electrical plug. When the electrical plug is inserted into the receiving cavity 13, the fourth contacting portion 243 of the elastic terminal 242 and the resisting portion 32 of the retaining member 3 are substantially symmetrically located at two lateral sides of the electrical plug along a transverse direction perpendicular to the front-to-rear direction. Therefore, the fourth contacting portion 243 and the resisting portion 32 also will give the electrical plug a balance force so as to prevent the electrical plug from swinging.

The metal shell 4 shields the main body 11 and has a number of legs 45 to be mounted on the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for insertion of an electrical plug, comprising:

an insulative housing having a receiving cavity for receiving the electrical plug in a front-to-rear direction and a plurality of receiving slots communicating with the receiving cavity; and a plurality of terminals received in the receiving slots and including first terminals, each first terminal having a vertical flat first base portion retained in the insulative housing and extending along the front-to-rear direction, a first contacting portion protruding into the receiving cavity to electrically contact with the electrical plug, and a first tail portion to be mounted on a printed circuit board (PCB); wherein both the first contacting portion and the first tail portion extend from a same one of an upper edge and a lower edge of the first base portion.

2. The electrical connector as claimed in claim 1, wherein the receiving slots are located at two lateral sides of the insulative housing and exposed to exterior for assembling the first terminals thereto from two lateral outsides of the insulative housing, the first contacting portion extends inwardly and upwardly from a front end of the lower edge, the first tail portion extends downwardly from a rear end of the lower edge.

3. The electrical connector as claimed in claim 1, wherein each first contacting portion defines a convex portion protruding into the receiving cavity to contact with the electrical plug.

4. The electrical connector as claimed in claim 1, wherein the first terminals are configured as a pair symmetrically located at two lateral sides of the electrical plug along a transverse direction perpendicular to the front-to-rear direction.

5. The electrical connector as claimed in claim 1, wherein the first base portion has a pair of first tooth portions protruding inwardly from the lower and upper edges thereof respectively to be retained in the insulative housing.

6. The electrical connector as claimed in claim 1, wherein the insulative housing has a gap on an upper side thereof, the terminals include a second terminal having a horizontal flat second base portion retained in the upper side of the insulative housing and extending along the front-to-rear direction, a second contacting portion extending sidewardly from a front end of a side edge at the second base portion and bending forwardly into the gap, and a second tail portion extending downwardly from a rear end of the second base portion to be mounted on the PCB, the second contacting portion defines a convex portion at the gap and protruding into the receiving cavity to contact with the electrical plug.

7. The electrical connector as claimed in claim 1, wherein the terminals include a third terminal retained in an lower side of the insulative housing, the third terminal have a vertical flat third base portion retained in the insulative housing and extending along a height direction of the insulative housing, a third contacting portion bending forwardly from an upper end of the third base portion, and a third tail portion extending downwardly from a lower end of the base portion to be mounted on the PCB.

8. The electrical connector as claimed in claim 1, wherein the electrical connector further comprises a retaining member, the retaining member has a retaining portion retained in the insulative housing, and a resisting portion extending from the retaining portion and protruding into the receiving cavity to press against the electrical plug.

9. The electrical connector as claimed in claim 8, wherein the resisting portion has a slit formed thereon and extending along the front-to-rear direction to engage with the electrical plug.

10. The electrical connector as claimed in claim 8, wherein the terminals further comprise switch terminals comprising an immovable terminal and an elastic terminal, the elastic terminal defines a fourth contacting portion brought into or out of contacting with the immovable terminal to detect the insertion of the electrical plug, the fourth contacting portion and the resisting portion are substantially symmetrically located at two lateral sides of the electrical plug along a transverse direction perpendicular to the front-to-rear direction.

11. The electrical connector as claimed in claim 1, wherein the first contacting portion and first tail portion are spaced from each other in the front-to-rear direction, said first contacting portion bends inwardly and extends in a first vertical direction perpendicular to said front-to-rear direction, said first tail portion extends in a second vertical direction parallel and opposite to the first contacting portion.

12. An electrical connector for insertion of an electrical plug, comprising:

an insulative housing having a main body, a cylindrical mating portion extending forwardly from a front face of the main body, and a receiving cavity formed in the mating portion and the main body for inserting the electrical plug in a front-to-rear direction;

a plurality of terminals including a pair of first terminals having vertical flat first base portions retained in two lateral sides of the main body and extending along the front-to-rear direction, first contacting portions extending from lower edges of the respective first base portions and protruding into the receiving cavity to electrically contact with the electrical plug, and first tail portions extending from the lower edges of the respective first base portions to be mounted on a printed circuit board (PCB); and a shell shielding the insulative housing.

13. The electrical connector as claimed in claim 12, wherein each first contacting portion bends inwardly and extends upwardly from the lower edge of the first base portion, the first tail portion extends downwardly from the lower edge of the first base portion and oppositely to the first contacting portion.

14. The electrical connector as claimed in claim 12, wherein the mating portion has a gap extending through an upper side thereof, the terminals include a second terminal having a horizontal flat second base portion retained in the upper side of the main body and extending along the front-to-rear direction, a second contacting portion extending sidewardly from a front end of a side edge at the second base portion and bending forwardly into the gap, and a second tail portion extending downwardly from a rear end of the second base portion to be mounted on the PCB, the second contacting portion defining a convex portion at the gap and protruding into the receiving cavity to contact with the electrical plug.

15. The electrical connector as claimed in claim 12, wherein the electrical connector further comprises a retaining member, the retaining member has a retaining portion retained in the main body, and a resisting portion extending forwardly from the retaining portion and protruding into the receiving cavity to press against the electrical plug.

16. The electrical connector as claimed in claim 15, wherein the resisting portion has a slit formed thereon and extending along the front-to-rear direction to engage with the electrical plug.

17. The electrical connector as claimed in claim 15, wherein the terminals further comprise switch terminals comprising an immovable terminal and an elastic terminal both retained in the main body, the elastic terminal defines a fourth contacting portion brought into or out of contacting with the immovable terminal to detect the insertion of the electrical plug, the fourth contacting portion and the resisting portion are substantially symmetrically located at two lateral sides of the electrical plug along a transverse direction perpendicular to the front-to-rear direction.

18. An electrical connector comprising:

an insulative housing defining a receiving cavity extending along a front-to-back direction for receiving a plug therein, and a plurality of receiving slots communicating with the receiving cavity;

a plurality of terminals disposed in the corresponding receiving slots, respectively, one of said terminals defining a horizontal base portion seated upon a top face of the housing and extending along said front-to-back direction, a horizontal contacting portion positioned upon the top face of the housing and extending along said front-to-back direction while offset from the base portion in a transverse direction perpendicular to said front-to-back direction, said contacting portion being deflectable in a vertical direction perpendicular to both said front-to-back direction and said transverse direction, a mounting tail downwardly extending from a rear region of the base portion in the vertical direction; wherein said one of the terminals is downwardly assembled to the top face of the housing in the vertical direction under condition that said contacting section defines a contact apex extending into the receiving cavity for engagement with the plug which is inserted into the receiving cavity along the front-to-back direction.

19. The electrical connector as claimed in claim 18, wherein said one of the terminals further includes a front retention tooth located on a front end of said base portion to secure said one of the terminals to the housing.

20. The electrical connector as claimed in claim 19, wherein said mounting tail is equipped with a rear retention tooth spaced from the front retention tooth in said front-to-back direction to secure said one of the terminals to the housing.

* * * * *